US006357265B1

(12) United States Patent
Chang

(10) Patent No.: US 6,357,265 B1
(45) Date of Patent: Mar. 19, 2002

(54) THEFTPROOF LOCK STRUCTURE

(76) Inventor: Hung-yi Chang, No. 336, Cheng-Kung Rd., Feng Yuan, Taichung, Hsien (TW)

( * ) Notice: Subject to any disclaimer, the term of this patent is extended or adjusted under 35 U.S.C. 154(b) by 0 days.

(21) Appl. No.: 09/612,449

(22) Filed: Jul. 7, 2000

(51) Int. Cl.[7] ..... E05B 45/06
(52) U.S. Cl. ..... 70/25; 70/DIG. 49; 340/542
(58) Field of Search ..... 70/24, 25, 26, 70/DIG. 49; 340/542

(56) References Cited

U.S. PATENT DOCUMENTS 3,720,082 A * 3/1973 Feinberg et al. ..... 70/25
4,970,881 A * 11/1990 Hsiao ..... 70/25
5,125,248 A * 6/1992 Ling ..... 70/25
5,406,257 A * 4/1995 Saito ..... 340/542
5,587,702 A * 12/1996 Chadfield ..... 340/542
5,727,405 A * 3/1998 Cromwell ..... 70/38 B
5,746,075 A * 5/1998 Yang ..... 70/25
5,786,759 A * 7/1998 Ling ..... 340/542

* cited by examiner

*Primary Examiner*—Michael J. Zanelli
*Assistant Examiner*—Eric M Gibson
(74) *Attorney, Agent, or Firm*—Rosenberg, Klein & Lee

(57) ABSTRACT

A theftproof lock structure includes a number lock body, an alarm, an elastic plate, and a rotary wheel set including a plurality of number wheels and follower wheels. One of the follower wheels includes a boss, and the elastic plate includes a tilt abutting piece detachably abutting the boss. When the number wheels are rotated to a correct position, the alarm is closed. When the number wheels are rotated to deviate from the correct position, the follower wheels are rotated with the number wheels to lock the padlock while the boss of the follower wheel is moved to detach from the abutting piece of the elastic plate, thereby starting the alarm. When a thief touches the number wheels, the buzzer of the alarm will be started to emit sound loudly, thereby efficiently achieving a theftproof function.

6 Claims, 7 Drawing Sheets

THEFTPROOF LOCK STRUCTURE

BACKGROUND OF THE INVENTION

1. Field of the Invention

The present invention relates to a theftproof lock structure.

2. Description of the Related Art

A conventional number lock in accordance with the prior art can be used for locking a luggage case or the like. However, the thief only needs to take the whole luggage case away without having to unlock the number lock at the site, thereby greatly limiting the versatility of the number lock.

SUMMARY OF THE INVENTION

In accordance with one aspect of the present invention, there is provided a theftproof lock structure comprising: a number lock body; an alarm mounted in the number lock body and including a circuit board, a buzzer, and a vibration switch; an elastic plate secured in the number lock body; a rotary wheel set pivotally mounted in the number lock body and including a plurality of number wheels, a plurality of follower wheels, and a support shaft extending through the number wheels and the follower wheels, each of the follower wheels rotated with the respective number wheel and including an annular flange having a flattened face; a lock retaining plate secured on the rotary wheel set and having a locking recess; and an U-shaped padlock secured on the number lock body and including a joint end having a neck secured in the locking recess of the lock retaining plate.

When the flattened face of the annular flange of each of the follower wheels is disposed in a horizontal manner, the lock retaining plate can be shifted so that the neck of the joint end of the padlock can be detached from the locking recess, thereby releasing the padlock from the number lock body.

In such a manner, the support shaft, the follower wheels and the elastic plate are made of conducting material. The circuit board of the alarm has a positive pole and a negative pole respectively connected to the support shaft and the elastic plate. One of the follower wheels includes a boss formed on the annular flange and located opposite to the flattened face. The elastic plate includes a tilt abutting piece detachably abutting the boss.

When the number wheels are rotated to a correct position, the flattened face of the annular flange of each of the follower wheels is disposed in a horizontal manner while the alarm is closed.

When the number wheels are rotated to deviate from the correct position, the follower wheels are rotated with the number wheels to lock the padlock while the boss of the annular flange of the follower wheel is moved to detach from the abutting piece of the elastic plate, thereby starting the alarm.

When a thief touches the number wheels, the vibration switch of the alarm is adapted to operate the buzzer of the alarm to emit sound loudly, thereby achieving a theftproof function.

Further benefits and advantages of the present invention will become apparent after a careful reading of the detailed description with appropriate reference to the accompanying drawings.

DETAILED DESCRIPTION OF THE INVENTION

Figure 1:
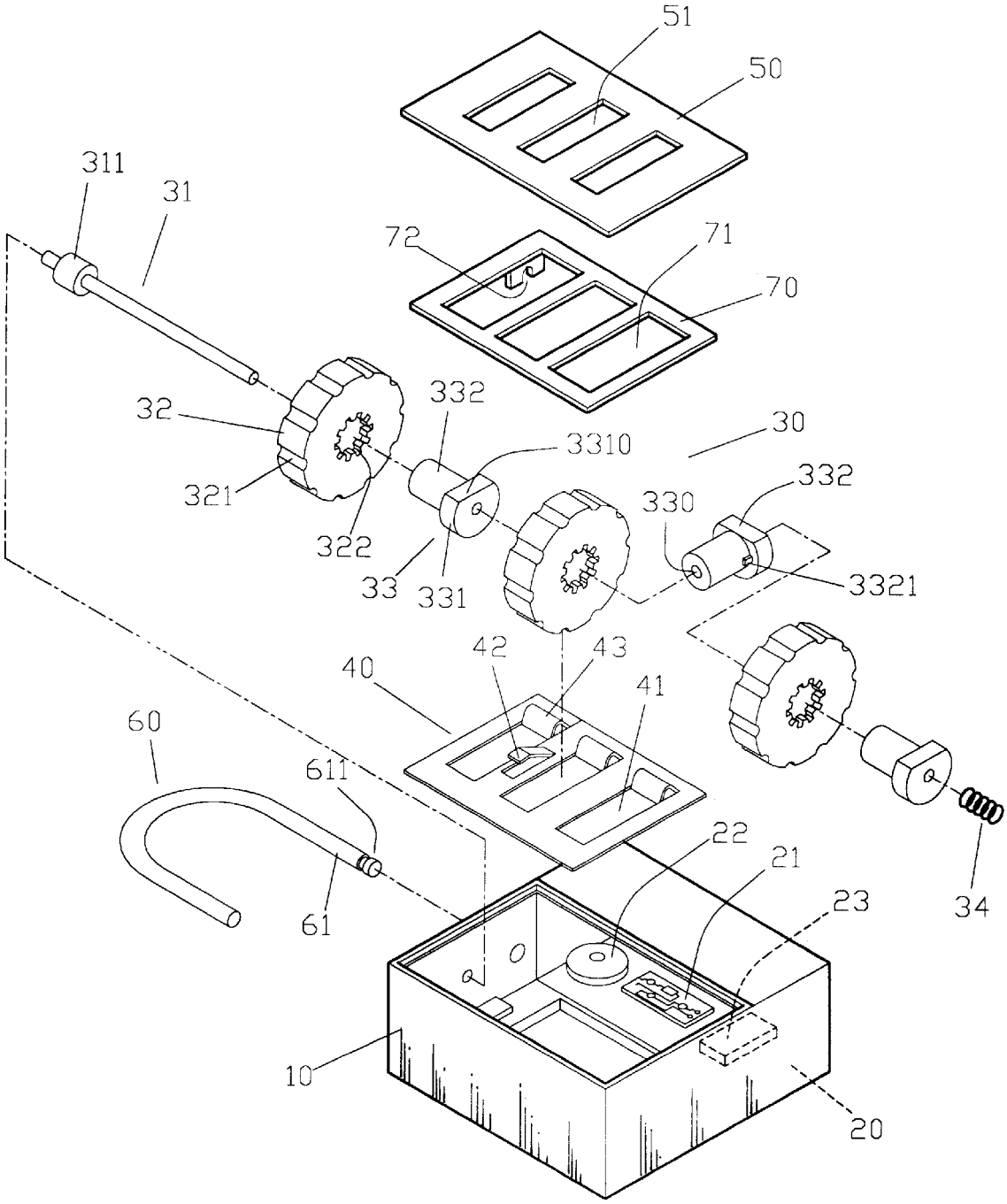
FIG. 1 is an exploded view of a theftproof lock structure in accordance with the present invention.
Figure 2:
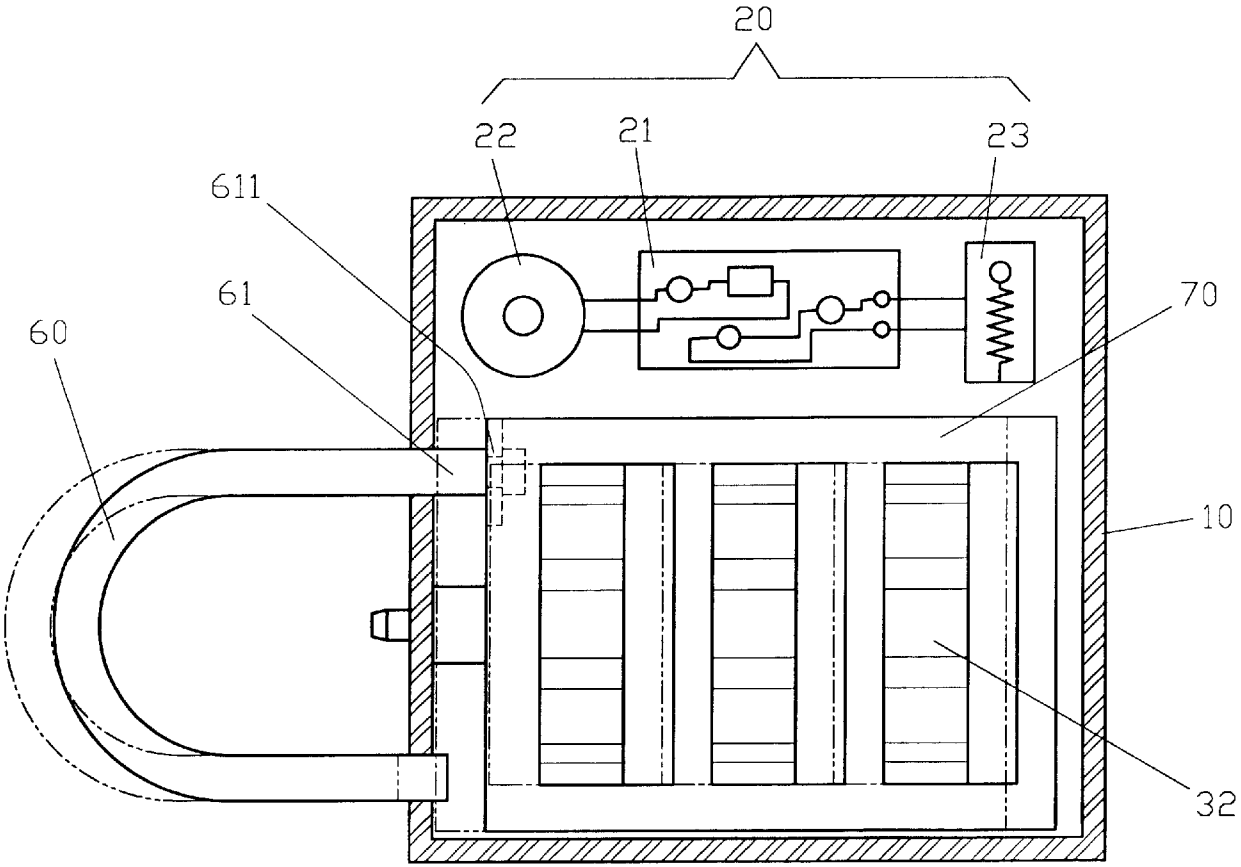
FIG. 2 is a top plan cross-sectional assembly view of the theftproof lock structure as shown in FIG. 1.

Referring to the drawings and initially to FIGS. 1–5, a theftproof lock structure in accordance with the present invention comprises a hollow number lock body 10, an alarm 20 mounted in the number lock body 10 and including a circuit board 21, a buzzer 22 and a vibration switch 23, an elastic plate 40 secured in the number lock body 10, a rotary wheel set 30 pivotally mounted in the number lock body 10 and including a plurality of number wheels 32, a plurality of follower wheels 33, and a support shaft 31 extending through the number wheels 32 and the follower wheels 33, a lock retaining plate 70 secured on the rotary wheel set 30 and having a locking recess 72, a cover plate 50 secured in the a top portion of the number lock body 10 and defining a plurality of elongated slots 51 for allowing passage of the respective number wheel 32, and an U-shaped padlock 60 secured on the number lock body 10 and including a joint end 61 having a neck 611 secured in the locking recess 72 of the lock retaining plate 70. The lock retaining plate 70 defines a plurality of openings 71 for allowing passage of the respective number wheel 32.

Each of the follower wheels 33 is rotated with the respective number wheel 32 and includes an annular flange 331 of a larger diameter having a flattened face 3310. When the flattened face 3310 of the annular flange 331 of each of the follower wheels 33 is disposed in a horizontal manner, the lock retaining plate 70 can be shifted so that the neck 611 of the joint end 61 of the padlock 60 can be detached from the locking recess 72, thereby releasing the padlock 60 from the number lock body 10.

Each of the number wheels 32 has an inner wall defining a plurality of tooth-shaped locking grooves 322 and an outer wall defining a plurality of indents 321. Each of the follower wheels 33 includes an axle 332 extending from the annular flange 331 and secured in the respective number wheel 32, and a locking stub 3321 mounted on the axle 332 and secured in one of the locking grooves 322 so that each of the follower wheels 33 is rotated with the respective number wheel 32.

The elastic plate 40 defines a plurality of receiving slots 41 for receiving the respective number wheel 32, and each of the receiving slots 41 is provided with a bent stop piece 43 abutting one of the indents 321 of the respective number wheel 32 for positioning the number wheel 32.

The support shaft 31 in turn extends through a center hole 330 defined in each of the follower wheels 33 and has one end provided with a catch block 311 abutting a first one of the follower wheels 33, and the rotary wheel set 30 further includes a spring 34 biased between a last one of the follower wheels 33 and an inner wall of the number lock body 10.

The support shaft 31, the follower wheels 33 and the elastic plate 40 are made of conducting material, and the circuit board 21 of the alarm 20 has a positive pole and a negative pole respectively connected to the support shaft 31 and the elastic plate 40.

Figure 4:
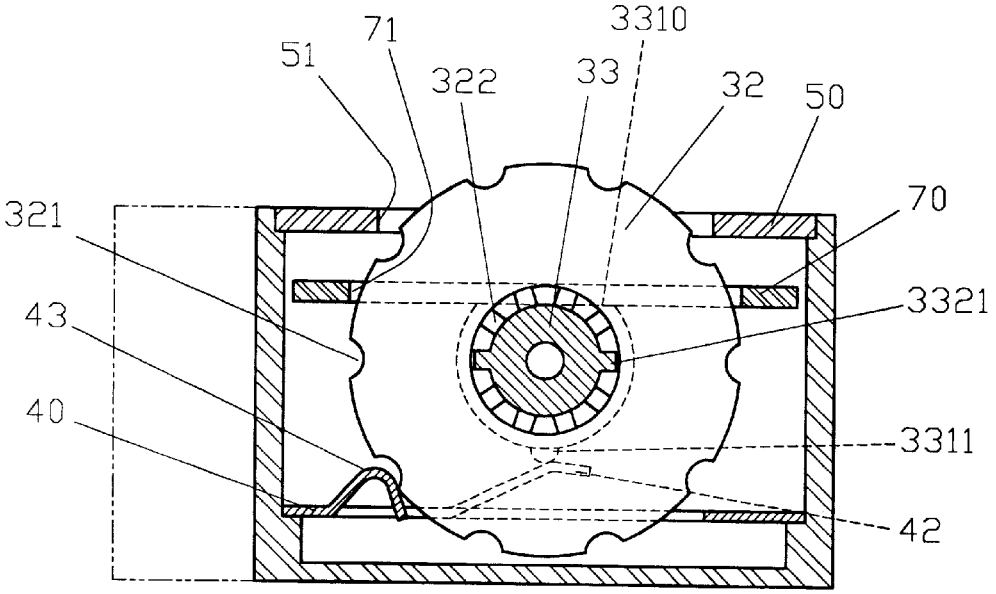
FIG. 4 is a side plan cross-sectional assembly view of the theftproof lock structure as shown in FIG. 1.

One of the follower wheels 33 includes a boss 3311 formed on the annular flange 331 and located opposite to the flattened face 3310, and the elastic plate 40 includes a tilt abutting piece 42 detachably abutting the boss 3311 as shown in FIG. 4.

When the number wheels 32 are rotated to a correct position as shown in FIG. 4, the flattened face 3310 of the annular flange 331 of each of the follower wheels 33 is disposed in a horizontal manner. In such a situation, the lock retaining plate 70 can be shifted so that the neck 611 of the joint end 61 of the padlock 60 can be detached from the locking recess 72, thereby releasing the padlock 60 from the number lock body 10. At the same time, the number wheel 32 for controlling the alarm 20 is disposed at its correct position where the boss 3311 abuts and presses the abutting piece 42 so that the alarm 20 is closed.

When the number wheel 32 for controlling the alarm 20 is disposed at its correct position, and the other number wheels 32 are rotated to deviate from the correct position, the follower wheels 33 are rotated with the number wheels 32 to lock the padlock 60. In such a manner, the alarm 20 is still closed due to the boss 3311 abutting the abutting piece 42, and the padlock 60 is locked by the number wheels 32 so that the padlock 60 can be locked without starting the alarm 20.

Figure 5:
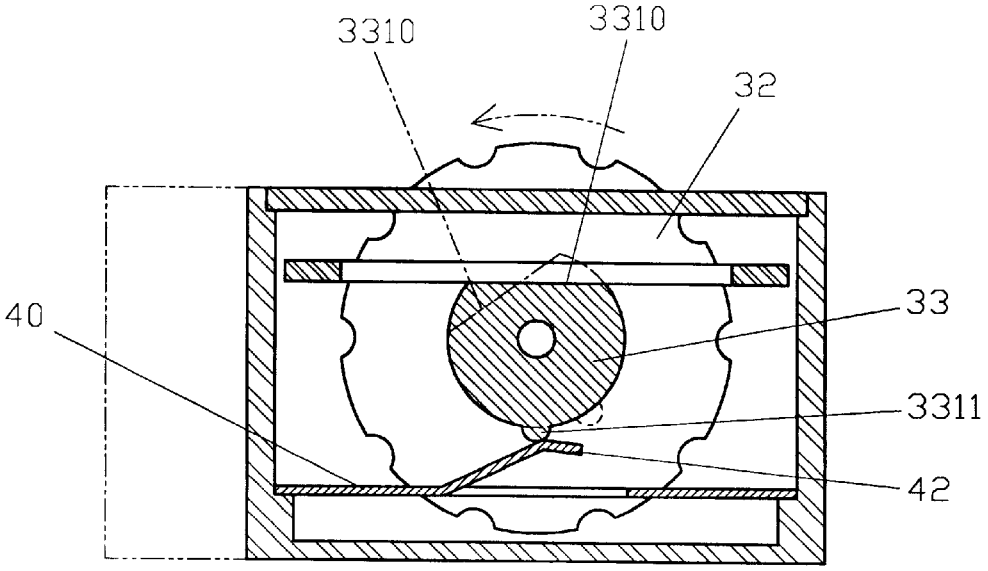
FIG. 5 is an operational view of the theftproof lock structure as shown in FIG. 4.

When the number wheel 32 for controlling the alarm 20 is rotated to deviate from its correct position as shown in FIG. 5, the boss 3311 of the annular flange 331 of the follower wheel 33 for controlling the alarm 20 is moved to detach from the abutting piece 42 of the elastic plate 40, thereby starting the alarm 20. In such a manner, the alarm 20 is started, and the padlock 60 is still locked. Accordingly, when a thief touches and rotates the number wheels 32 for unlocking the padlock 60, the vibration switch 23 of the alarm 20 is started and adapted to operate the buzzer 22 of the alarm 20 to emit sound loudly, thereby achieving a theftproof function.

The user can rotate the number wheel 32 for controlling the alarm 20 to its correct position to close the alarm 20 so as to lock and unlock the padlock 60 without starting the alarm 20.

Figure 3:
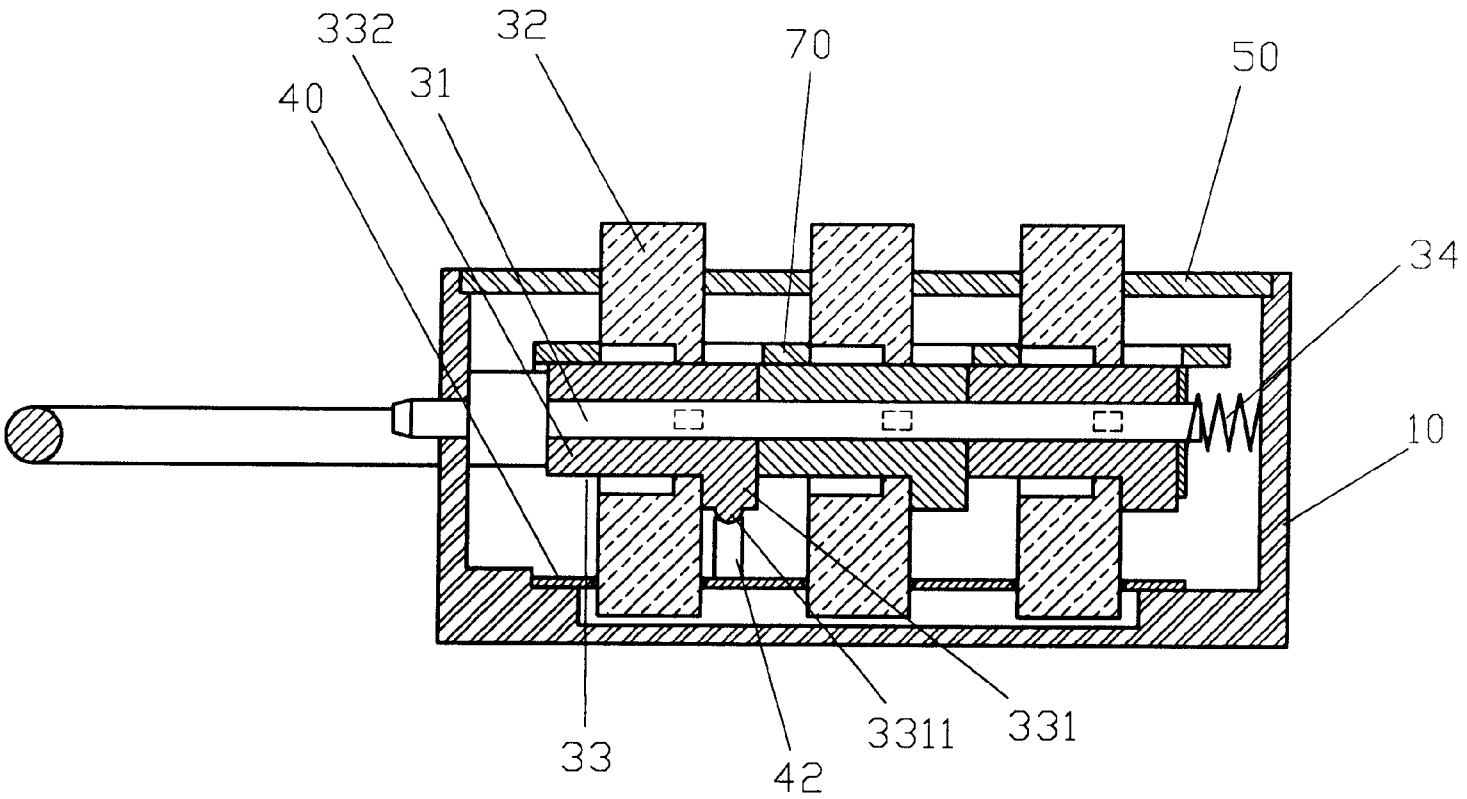
FIG. 3 is a front plan cross-sectional assembly view of the theftproof lock structure as shown in FIG. 1.
Figure 6:
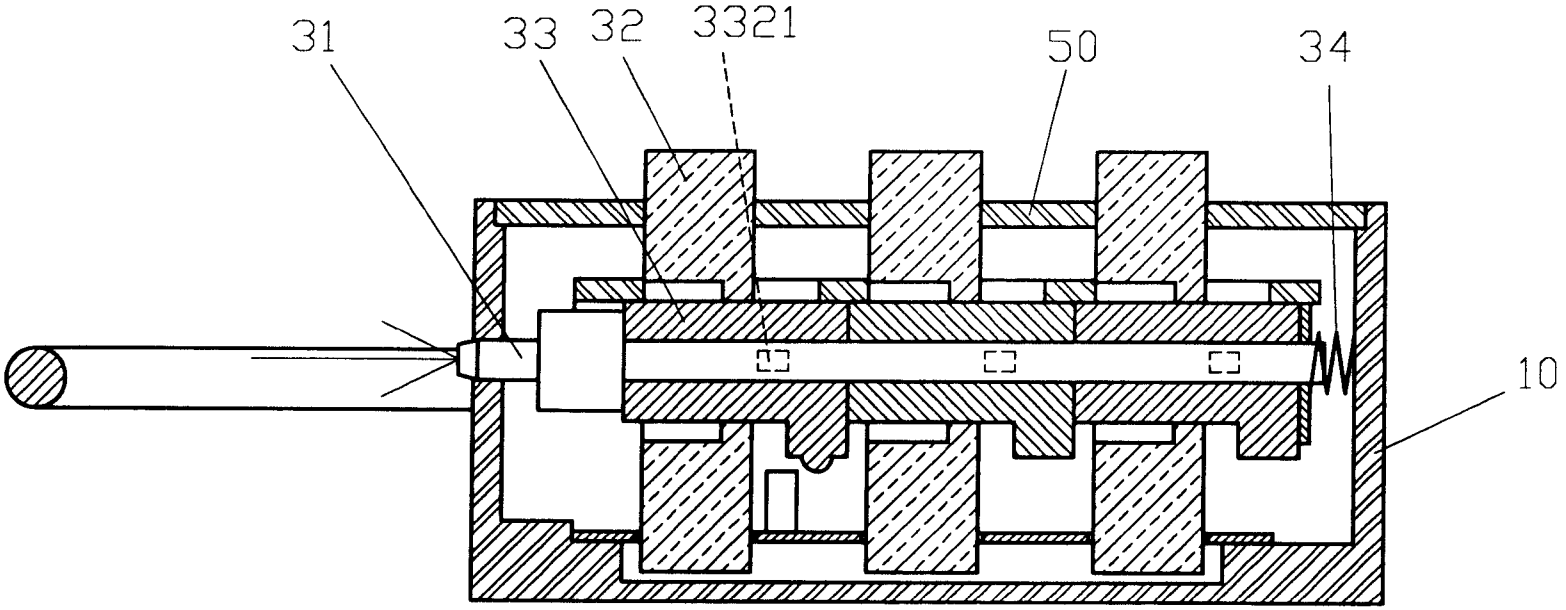
FIG. 6 is an operational view of the theftproof lock structure as shown in FIG. 3.

When the user wishes to change the unlocking codes of the number lock, the number wheels 32 are initially rotated to their correct positions as shown in FIG. 3. The support shaft 31 is then pressed so as to axially displace each of the follower wheels 33 from the position as shown in FIG. 3 to the position as shown in FIG. 6, thereby detaching the locking stub 3321 of each of the follower wheels 33 from the locking groove 322 of each of the number wheels 32. Each of the number wheels 32 can then be rotated to a position indicating the desired number to be changed, and the locking stub 3321 of each of the follower wheels 33 is then again inserted into the locking groove 322 of each of the number wheels 32, thereby changing unlocking codes of the number lock.

Figure 7:
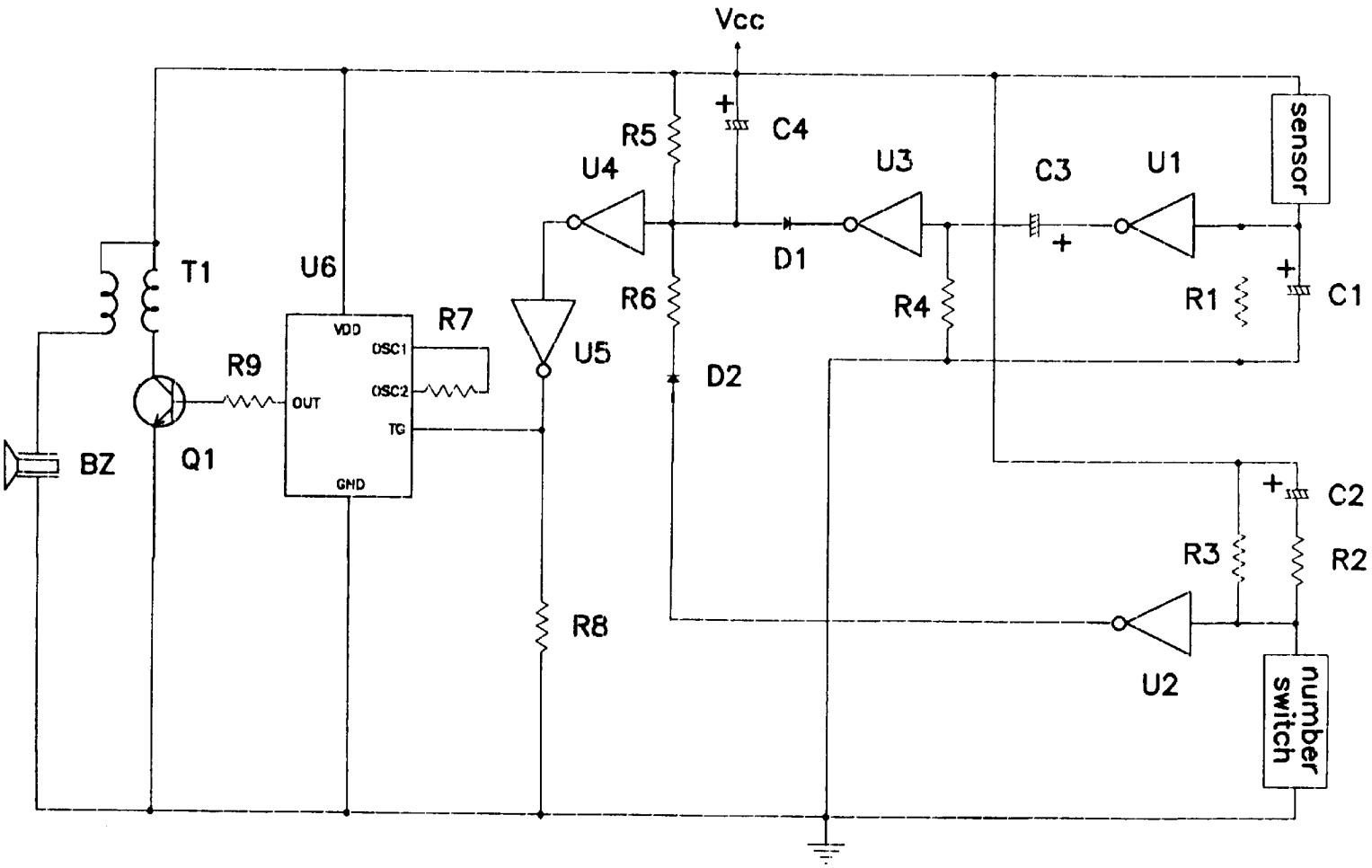
FIG. 7 is a circuit diagram of an alarm of theftproof lock structure in accordance with the present invention.
Figure 8:
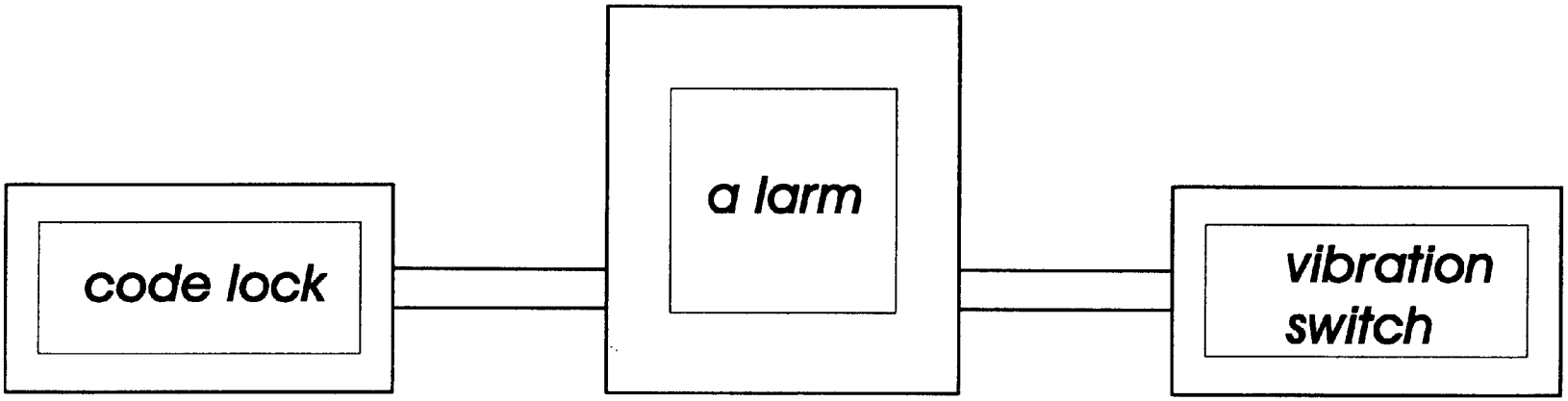
FIG. 8 is a block diagram of the alarm as shown in FIG. 7.

FIG. 7 shows a circuit diagram of the alarm 20, and FIG. 8 shows a block diagram of the alarm 20.

When the circuit is disposed at a closed state, the number lock switch is disposed at a short circuit state. Therefore, the input side of "U2" connects the ground, and the output side of "U2" supplies a high voltage through "D2" and "R6" to "U4", thereby depressing the signals supplied from the vibration switch 23.

When the circuit is started, the number lock switch is disposed at an open state. In such a situation, "R2" and "C2" form a delay circuit so that "U2" will supply a low voltage by means of delaying three seconds to cancel the depression signal. Therefore, the signal will fluently enter into "U6" when the vibration switch 23 is operated.

When the vibration switch is triggered after the circuit is started, the signal is delayed by three seconds through "R1", "C1", "R4" and "C3". Then, the signal is sent to "U3" to start the timing circuit "R2" and "C4". In such a manner, "U6" receives the triggered signal supplied from "U4" and "U5" to generate alarm sound. "C4" and "R5" used for calculating time is set to two minutes. The alarm sound will stop after two minutes, and will return to its alert state.

When the circuit is closed, the code lock switch will return to a short circuit state. Therefore, the input side of "U2" connects the ground, and "R3" and "C2" form a delay circuit. The high voltage is sent through "D2" and "R6" to "U4", thereby depressing the signals supplied from the vibration switch.

When the numbers of the theftproof lock are rotated to a correct position, the circuit is short while the alarm is closed. When the numbers of the theftproof lock are rotated to a wrong position, the circuit is opened while the alarm is started. The user cannot touch the theftproof lock again after the alarm is started. When the theftproof lock is vibrated due to an external force, the vibration switch is started. The alarm will emit the alarm sound by delaying three seconds so that the user has enough time to cancel the alarm.

After the alarm emits the alarm sound, the closing action of the theftproof lock will be delayed by three seconds so that the thief cannot immediately know if the numbers rotated by him are correct, thereby greatly increasing the difficulty of unlocking the theftproof lock. After the alarm is activated, the user has to rotate the number wheels of the code lock to their correct positions, and to wait for three seconds so as to close the alarm.

It should be clear to those skilled in the art that further embodiments may be made without departing from the scope of the present invention.

What is claimed is:

1. A theftproof lock structure comprising:

a number lock body (10);

an alarm (20) mounted in said number lock body (10) and including a circuit board (21), a buzzer (22), and a vibration switch (23);

an elastic plate (40) secured in said number lock body (10);

a rotary wheel set (30) pivotally mounted in said number lock body (10) and including a plurality of number wheels (32), a plurality of follower wheels (33), and a support shaft (31) extending through said number wheels (32) and said follower wheels (33), each of said follower wheels (33) rotated with said respective number wheel (32) and including an annular flange (331) having a flattened face (3310);

a lock retaining plate (70) secured on said rotary wheel set (30) and having a locking recess (72); and an U-shaped padlock (60) secured on said number lock body (10) and including a joint end (61) having a neck (611) secured in said locking recess (72) of said lock retaining plate (70);

whereby, when said flattened face (3310) of said annular flange (331) of each of said follower wheels (33) is disposed in a horizontal manner, said lock retaining plate (70) can be shifted so that said neck (611) of said joint end (61) of said padlock (60) can be detached from said locking recess (72), thereby releasing said padlock (60) from said number lock body (10);

wherein, said support shaft (31), said follower wheels (33) and said elastic plate (40) are made of conducting material, said circuit board (21) of said alarm (20) has a positive pole and a negative pole respectively connected to said support shaft (31) and said elastic plate (40), one of said follower wheels (33) includes a boss (3311) formed on said annular flange (331) and located opposite to said flattened face (3310), said elastic plate (40) includes a tilt abutting piece (42) detachably abutting said boss (3311), when said number wheels (32) are rotated to a correct position, said flattened face (3310) of said annular flange (331) of each of said follower wheels (33) is disposed in a horizontal manner while said alarm (20) is closed, when said number wheels (32) are rotated to deviate from said correct position, said follower wheels (33) are rotated with said number wheels (32) to lock said padlock (60) while said boss (3311) of said annular flange (331) of said follower wheel (33) is moved to detach from said abutting piece (42) of said elastic plate (40), thereby starting said alarm (20), when a thief touches said number wheels (32), said vibration switch (23) of said alarm (20) is adapted to operate said buzzer (22) of said alarm (20) to emit sound, thereby achieving a theftproof function.

2. The theftproof lock structure in accordance with claim 1, wherein each of said number wheels (32) has an inner wall defining a plurality of tooth-shaped locking grooves (322) and an outer wall defining a plurality of indents (321), and each of said follower wheels (33) includes an axle (332) secured in said respective number wheel (32), and a locking stub (3321) mounted on said axle (332) and secured in one of said locking grooves (322) so that each of said follower wheels (33) is rotated with said respective number wheel (32).

3. The theftproof lock structure in accordance with claim 2, wherein said elastic plate (40) defines a plurality of receiving slots (41) for receiving said respective number wheel (32), and each of said receiving slots (41) is provided with a bent stop piece (43) abutting one of said indents (321) of said respective number wheel (32).

4. The theftproof lock structure in accordance with claim 1, wherein said support shaft (31) has one end provided with a catch block (311) abutting a first one of said follower wheels (33), and said rotary wheel set (30) further includes a spring (34) biased between a last one of said follower wheels (33) and an inner wall of said number lock body (10).

5. The theftproof lock structure in accordance with claim 1, wherein said lock retaining plate (70) defines a plurality of openings (71) for allowing passage of said respective number wheel (32).

6. The theftproof lock structure in accordance with claim 1, further comprising a cover plate (50) secured in said a top portion of said number lock body (10) and defining a plurality of elongated slots (51) for allowing passage of said respective number wheel (32).

* * * * *